US008197640B2

(12) United States Patent
Schaffer

(10) Patent No.: US 8,197,640 B2
(45) Date of Patent: Jun. 12, 2012

(54) PAPER MAKING PROCESS USING CATIONIC POLYACRYLAMIDES AND CROSSLINKING COMPOSITIONS FOR USE IN SAME

(75) Inventor: Joseph Schaffer, Marietta, GA (US)

(73) Assignee: Bercen, Inc., Denham Springs, LA (US)

( * ) Notice: Subject to any disclaimer, the term of this patent is extended or adjusted under 35 U.S.C. 154(b) by 617 days.

(21) Appl. No.: 11/880,252

(22) Filed: Jul. 20, 2007

(65) Prior Publication Data

US 2008/0216979 A1 Sep. 11, 2008

Related U.S. Application Data

(60) Provisional application No. 60/832,689, filed on Jul. 21, 2006.

(51) Int. Cl.
*D21H 17/33* (2006.01)
*D21H 17/49* (2006.01)
*D21H 21/20* (2006.01)

(52) U.S. Cl. ..... 162/168.3; 162/158; 162/164.6; 162/166; 162/185; 525/55; 525/326.1; 525/329.4; 525/383

(58) Field of Classification Search ..... 162/164.6, 162/166, 168.3, 185, 158; 525/55, 326.1, 525/329.4, 383
See application file for complete search history.

(56) References Cited

U.S. PATENT DOCUMENTS 3,556,932 A * 1/1971 Coscia et al. ..... 162/166
4,605,702 A * 8/1986 Guerro et al. ..... 525/154
5,723,022 A * 3/1998 Dauplaise et al. ..... 162/168.3
5,763,523 A * 6/1998 Chen et al. ..... 524/521
2005/0155732 A1* 7/2005 Capwell ..... 162/158
2006/0037727 A1* 2/2006 Hagiopol et al. ..... 162/168.3
2006/0162886 A1* 7/2006 Smith et al. ..... 162/166
2009/0223645 A1* 9/2009 Zhang et al. ..... 162/164.6

OTHER PUBLICATIONS

Hawley's Condensed Chemical Dictionary, 14th Edition, John Wiley & Sons, Inc., 2002 [online] [retrieved on Jul. 27, 2011], Retrieved from the Internet: <URL: http://www.knovel.com/web/portal/basic_search/display?_EXT_KNOVEL_DISPLAY_bookid=704>.*

McNaught et al, IUPAC. Compendium of Chemical Terminology, 2nd ed. (the "Gold Book") Blackwell Scientific Publications (1997) [online] [retrieved on Jul. 27, 2011], Retrieved from the Internet: <URL: http://goldbook.iupac.org/PDF/E02192.pdf>.*

Farley, "Glyoxalated Polyacrylamide Resin", Wet Strength Resins and Their Application, Chapter 3, TAPPI Press, 1994, p. 45.*

International Search Report for PCT/US 07/16445.

* cited by examiner

*Primary Examiner* — Matthew Daniels

*Assistant Examiner* — Dennis Cordray

(74) *Attorney, Agent, or Firm* — Ceasar, Rivise, Bernstein, Cohen & Pokotilow, Ltd.

(57) ABSTRACT

The present invention relates to methods for manufacturing paper or paperboard with improved strength, the methods comprising the addition of the reaction product of a cationic polyacrylamide and an aqueous aldehyde generating compound or a glyoxal releasing compound, or glyoxal itself, prepared at the mill site at high concentrations, then diluted and added into a fiber furnish prior to forming or drying of the paper or paperboard sheet.

18 Claims, No Drawings

PAPER MAKING PROCESS USING CATIONIC POLYACRYLAMIDES AND CROSSLINKING COMPOSITIONS FOR USE IN SAME

RELATED APPLICATION

This application claims the benefit of U.S. provisional patent application Ser. No. 60/832,689 filed Jul. 21, 2006, the disclosure of which is incorporated herein in its entirety by this reference.

BACKGROUND OF THE INVENTION

1. Field of the Invention

The present invention provides methods of manufacturing paper and paperboard materials having increased dry and temporary wet strength, and more particularly provides a method of making paper and paperboard materials possessing increased temporary wet and dry strength, wherein the strength improving compositions do not have shelf-life and gelling problems due to premature crosslinking. The methods of the invention comprise the addition, at the paper or paperboard mill site, of a crosslinker composition comprising at least one aldehyde generating or other suitable crosslinking compound, preferably a glyoxal releasing compound, or more preferably glyoxal itself, to a 10%-50% solution of a cationic polyacrylamide to be reacted immediately prior to its addition to the fiber composition at the wet end of the paper making process. The aldehyde generating or other suitable crosslinking compound, preferably the glyoxal releasing compound, or more preferably the glyoxal itself, is combined with a cationic polyacrylamide compound and reacted for a certain time at a certain temperature to reach a desired degree of crosslinking (prior to the necessary dilution to provide uniform distribution of the reacted material in the fiber slurry) before adding it to the fiber slurry at the wet end of the paper making process.

Since these type of crosslinking reactions depend to a high degree on a good number of parameters such as time, temperature, pH, reactant concentrations and ratios; satisfactory control of the desired degree of crosslinking is a very complex task. To carry out this on-site reaction in a practical way, under precisely controlled conditions, a suitable reactor technology must be selected that is capable of accomplishing very rapid mixing and instant heating without the use of conventional heat transfer methods.

One currently known such technology is inline mixing combined with microwave heating. Another, more preferred technology applies cavitation energy for extremely rapid simultaneous mixing and heating in one step. An eminently suitable device/reactor to accomplish this task is described by J. L. Griggs in U.S. Pat. No. 5,188,090.

In certain other methods of the invention the aldehyde generating or other suitable crosslinking compound, more preferably the glyoxal releasing compound, or simply the glyoxal itself, is contacted as a spray with the drained paper or paperboard web formed from a mixture comprising a fiber slurry and a cationic polyacrylamide composition.

2. Background

A great variety of wet end additives are available for improving paper strength. These additives must have a given cationic charge to provide their molecules with sufficient affinity to be retained on negatively charged cellulose fibers.

In addition, these chemistries are commonly modified to be more effective in improving temporary wet strength by incorporating thermosetting properties through the use of crosslinking agents like glyoxal.

However, through the use of crossliners a problem arises regarding the stability and storage life of these preparations.

In most cases significant dilution to as low as 8.0% active solids concentration, pH adjustment to 3.0-4.0, and lower than room temperatures are needed to ensure somewhat practical lengths of shelf lives.

Some of these currently used commercial strength additives have less than 3 weeks of storage life, especially during the summer months.

The crosslinking of starch with multi-functional reagents, which are reactive with starch hydroxyl groups, is well known. Glyoxal and polyaldehyde compounds and resins have been previously utilized as crosslinkers. Simple mixing of glyoxal with a starch dispersion rapidly affords a gel. However, glyoxal is infinitely soluble in water and does not interact efficiently with other chemicals or compositions, particularly heterogeneous materials dispersed in small quantities in large volumes of water, e.g., such as gelatinized starch molecules or cellulosic fibers present in the wet-end of the paper making process. Thus, addition of glyoxal or other low molecular weight crosslinkers directly to the wet-end of the papermaking process has not been found to provide benefit to end product of the paper making process.

U.S. Pat. No. 6,303,000 issued to Floyd et al. (Floyd '000) discloses gelatinized starch compositions crosslinked with a glyoxal resin and the use of same in paper making. The crosslinked starch composition of Floyd '000 comprise the reaction product formed by heating starch with a blocked glyoxal resin such as those resins recited in U.S. Pat. No. 4,695,606 (Floyd, '606) during the gelatinization process. The heating process forms a gelatinized starch that is crosslinked by the glyoxal resin. More particularly, Floyd '000 discloses the addition of a crosslinked gelatinized starch composition to the wet end of the paper making process. In other words, prior to addition to the wet end, the starch is heated with the blocked glyoxal resin to gelatinize the starch and induce a crosslinking reaction between the glyoxal and the starch. The Floyd '000 patent further discloses that the glyoxal resin can be pre-mixed with the starch prior to the gelatinization heating step or added during the starch gelatinization process. Floyd suggests that pre-mixing the starch and blocked glyoxal resin prior to the gelation process or addition of the blocked glyoxal resin during the gelatinization process, affords superior material having improved shelf stability.

The Floyd '606 patent describes paper binder compositions comprising a mixture of an acrylic or vinyl polymer with a blocked glyoxal resins, e.g., such as the reaction product of glyoxal and a urea or a cyclic urea. More particularly, the blocked glyoxal resin is a condensation polymer of glyoxal blocked with urea, cyclic ureas such as ethylene urea, 4,5-dihydroxyethylene urea and propylene urea, carbamates, glycols, or polyols.

In Floyd '000 the addition levels of the gelatinized starch composition demonstrated to affect a significant improvement in paper or paperboard strength are relatively high at the level of 40 lb or more dry starch composition per ton of dry pulp. It is well known in the art of papermaking that significant issues may occur when relatively high levels of starch are used to produce paper, including high cost, high levels of effluent Biological Oxygen Demand (BOD), reduction in paper opacity, machine deposits, and problems with dewatering and drying the paper or paperboard leading to reduced production rates. It would thus be desirable to have paper strength compositions that are effective at lower levels of usage.

A variety of polymeric stabilizing agents have been recited which are capable of stabilizing at lest one aldehyde residue of a plurality of glyoxal compounds. More particularly a variety of polyacrylamide or copolymers of acrylamide and an unsaturated aliphatic carboxylic acid, which have a plurality of glyoxal equivalents attached to the polymer chain through pendant amide groups of the acrylamide residues.

U.S. Pat. No. 3,556,932 teaches poly(acrylamide) substituted with glyoxal, e.g., a polymer chain with —C(O)NHCH(OH)CHO side chains. However, because of stability issues, this thermosetting polymer must be in the form of an 8.0% solution and has a shelf life of only about 24 days.

U.S. Pat. No. 5,543,446 teaches terpolymers composed of (meth)acrylamide mononomers, unsaturated aliphatic carboxylic acid monomers, and a di- or polyvinyl monomer. The terpolymers can be used to increase the wet strength of a paper web during the paper making process.

International patent publication, WO 00/11046 teaches a copolymer of acrylamide and an α,β-unsaturated carboxylic acid which has been modified with a dialdehyde such as glyoxal.

U.S. Pat. No. 7,034,087 teaches the use of aldehyde scavengers such as choline for improved stability.

U.S. Patent Application 2005/0187356 teaches the carrying out of the crosslinking reaction in two stages, in addition to using a scavenger.

As an alternative approach, it would be desirable to have a strength improving composition comprised of the reaction product of a stabilized dialdehyde generating compound, or a stabilized glyoxal compound, or only glyoxal, and a cationic polyacrylamide in the form of a solution of much greater than 8.0% solids content, available for immediate use without having to be concerned about the limited shelf-life of the said strength additive. It would also be desirable to provide methods of making paper and paperboard with increased strength using such crosslinking compositions.

SUMMARY OF THE INVENTION

The present invention provides strength improving compositions comprising at least one glyoxal releasing compound, or at least one dialdehyde generating compound, or glyoxal itself, reacted with a cationic polyacrylamide on-site of the paper or paperboard mill, thereby eliminating the need for conventional, low solids content storage stable strength additives.

These new compositions facilitate a process of manufacturing paper or paperboard having improved wet and/or dry strength. Preferably, the manufacturing processes of certain embodiments of the invention provide paper or paperboard materials with equivalent strength and a reduced basis weight when compared to paper or paperboard materials made with previous paper manufacturing processes.

In accord with the present invention, the invention provides a method for manufacturing paper or paperboard sheet with increased strength, the method comprising the steps of:

providing a fiber slurry and a cationic polyacrylamide composition, each of which is suitable for use in making paper or paperboard;

providing at least one crosslinker composition comprising at least one aldehyde generating compound capable of forming at least two or more covalent bonds to functional groups present in the cationic polyacrylamide compositions;

mixing and reacting the cationic polyacrylamide composition and the crosslinker composition at the paper mill site to form a strength enhancer;

diluting the mixture of the cationic polyacrylamide composition and the crosslinker composition;

adding a strength enhancer to the fiber slurry; and forming the paper or paperboard sheet;

wherein the increased strength is increased wet strength or increased dry strength;

wherein the dilution of the strength enhancer provides a concentration that prevents gelation and reduces shelf-life and storage concerns.

The invention also provides a method for manufacturing paper or paperboard sheet with increased strength, the method comprising the steps of:

providing a fiber slurry that is suitable for use in making paper or paperboard;

providing a cationic polyacrylamide composition;

providing at least one crosslinker composition comprising at least one aldehyde generating compound capable of forming at least two or more covalent bonds to functional groups present in the cationic polyacrylamide composition;

pre-mixing the polyacrylamide and the crosslinker compositions prior to the reacting of the pre-mix at the paper mill site;

reacting the pre-mixed cationic polyacrylamide and crosslinker compositions at the paper mill site to form a strength enhancer;

diluting the reacted mixture of the cationic polyacrylamide composition and the crosslinker composition;

adding a strength enhancer to the fiber slurry; and forming the paper or paperboard sheet;

wherein the increased strength is increased wet strength or increased dry strength;

wherein the dilution of the strength enhancer provides a concentration that prevents gelation.

The invention also provides a method for manufacturing paper or paperboard sheet with increased strength, the method comprising the steps of:

providing a fiber slurry and a cationic polyacrylamide composition, each of which is suitable for use in making paper or paperboard;

providing at least one crosslinker composition comprising at least one aldehyde generating compound capable of forming at least two or more covalent bonds to functional groups present in the cationic polyacrylamide or a fiber of a web;

preparing a paper or paperboard web comprising pulp fiber and at least one cationic polyacrylamide composition, prepared by mixing the cationic polyacrylamide composition and the fiber slurry;

contacting the web with the crosslinker composition under conditions conducive to complete absorption of the crosslinking composition into the web and the formation of at least two or more covalent bonds to functional groups present in the cationic polyacrylamide composition or to the fiber of the web upon heating and drying the web;

wherein the increased strength is increased wet strength or increased dry strength.

The cationic polyacrylamide compositions of the present invention are devoid of concerns of other paper-making compositions in that the cationic polyacrylamide compositions are made on-site of the paper or paperboard mill, and therefore do not require treatments to prevent gelation or increase storage times or shelf life.

DETAILED DESCRIPTION OF THE INVENTION

For the purposes of the present invention "cationic polyacrylamides" refers to polymeric compounds comprising of at least 50.0 mole % acrylamide monomer, at least 0.05 mole % cationic co-monomers such as diallyl dimethyl ammonium chloride (DADMAC), vinylpyridines, dimethylaminopropyl acrylamide, p-dimethylaminoethylstyrene, or other unsaturated cationic co-monomers known to one of ordinary skill in the art.

Other water soluble or insoluble vinyl monomers of nonionic or anionic nature can be used as diluter monomers which may or may not be reactive to glyoxal of other crosslinkers.

If desired, branching of the linear base polymer may be introduced by using di-functional monomers such as N,N'-methylene-bisacrylamide.

For the purpose of the present invention "cationic polyacrylamide compositions" refers to the base cationic polyacrylamide component blended with other crosslinkable strength imparting components such as any known water soluble or dispersible natural gums, hydrolyzed starches, common wet end starches, hemicelluloses, cellulose derivatives (e.g. CMC), polyvinylalcohols, polyvinylamines, or other crosslinkable compounds known to those skilled in the art.

For the purposes of the present invention, the term "aldehyde generating compound" refers to materials that degrade at ambient or elevated temperatures upon exposure to a cationic polyacrylamide composition, or pulp fiber to generate compounds containing two or more reactive aldehyde residues that are then available for reaction with functional groups that generally react in an aqueous environment with amide or hydroxyl groups. Moreover, the term aldehyde generating compound includes those compounds capable of generating polyaldehyde compounds upon degradation and compounds capable of generating one or more aldehyde groups in sequence such that two or more covalently connected aldehyde residues are generated during the degradation of the aldehyde generating compound. Particularly preferred aldehyde generating compounds release glyoxal or generate one or two aldehyde groups which are derived from glyoxal.

For the purposes of the present invention, the term "glyoxal releasing compound" refers to glyoxal and to materials that degrade at ambient or elevated temperatures upon exposure to cationic polyacrylamide compositions, or pulp fiber to generate compounds containing reactive glyoxal moieties that are then available for reaction with functional groups that generally react in an aqueous environment with glyoxal. In general, glyoxal releasing compounds are a subset of aldehyde generating compounds.

For the purposes of the present invention, the term "blocked aldehyde residue" refers to structures in which at least one aldehyde group is hindered from forming free or active aldehyde groups under storage or wet end paper making conditions. Similarly, the term "blocked glyoxal residue," as used herein, refers to structures in which the glyoxal generating group is hindered from forming a free or active aldehyde group under the current conditions present. The term "unblocked glyoxal residue," as used herein, refers to structures in which at least one glyxoal aldehyde residue is present as a reactive aldehyde group, i.e., a CHO group.

For the purposes of the present invention, the term "stabilizing agent" refers to any compound or combination of compounds capable of forming a linear, branched, or cyclic structure which comprises one or more equivalents of glyoxal as a part of the linear, branched or cyclic structure or as a substituent thereof. Preferred stabilizing agents are capable of masking, blocking or otherwise protecting one, or preferably, two aldehyde functional groups of glyoxal from undergoing undesired reactions prior to the application of heat as in the drying step of the paper making process.

For the purposes of the present invention, the term "aldehyde blocking agent" refers to any compound or combination of compounds capable of masking, blocking or otherwise protecting an aldehyde functional group and preferably are capable of masking or blocking aldehyde functional groups in an aqueous environment. Typically preferred aldehyde blocking agents release or unmask the aldehyde group at elevated temperatures such as the temperature used to dry paper or paperboard.

The present invention provides methods of manufacturing paper and paperboard materials having increased dry and temporary wet strength, and more particularly provides a method of making paper and paperboard materials possessing increased temporary wet and dry strength, wherein the strength improving compositions do not have shelf-life and gelling problems due to premature crosslinking. The methods of the invention comprise the addition, at the paper or paperboard mill site, of a crosslinker composition comprising at least one aldehyde generating compound, or preferably a glyoxal releasing compound, or more preferably glyoxal itself, to a 10%-50% solution of a cationic polyacrylamide composition to be reacted immediately prior to its addition to the fiber composition at the wet end of the paper making process. The aldehyde generating compound, or preferably the glyoxal releasing compound, or more preferably the glyoxal itself, is combined with a cationic polyacrylamide composition and reacted for a certain time at a certain temperature to reach a desired degree of crosslinking (prior to the necessary dilution to provide uniform distribution of the reacted material in the fiber slurry) before adding it to the fiber slurry at the wet end of the paper making process.

The present invention provides a method for manufacturing paper or paperboard sheet with increased strength, the method comprising the steps of:

providing a fiber slurry and a cationic polyacrylamide composition, each of which is suitable for use in making paper or paperboard;

providing at least one crosslinker composition comprising at least one aldehyde generating compound capable of forming at least two or more covalent bonds to functional groups present in the cationic polyacrylamide composition;

mixing and reacting the cationic polyacrylamide composition and the crosslinker composition at the paper mill site to form a strength enhancer;

diluting the mixture of the cationic polyacrylamide composition and the crosslinker composition;

adding the diluted strength enhancer to the fiber slurry; and forming the paper or paperboard sheet;

wherein the increased strength is increased wet strength or increased dry strength;

wherein the dilution of the strength enhancer provides a concentration that prevents gelation.

The invention also provides a method for manufacturing paper or paperboard sheet with increased strength, the method comprising the steps of:

providing a fiber slurry that is suitable for use in making paper or paperboard;

providing a cationic polyacrylamide composition;

providing at least one crosslinker composition comprising at least one:aldehyde generating compound capable of forming at least two or more covalent bonds to functional groups present in the cationic polyacrylamide composition;

pre-mixing the polyacrylamide and the crosslinker compositions prior to the reacting of the pre-mix at the paper mill site;

reacting the pre-mixed cationic polyacrylamide and crosslinker compositions at the paper mill site to form a strength enhancer;

diluting the reacted mixture of the cationic polyacrylamide composition and the crosslinker composition;

adding a strength enhancer to the fiber slurry; and forming the paper or paperboard sheet;

wherein the increased strength is increased wet strength or increased dry strength;

wherein the dilution of the strength enhancer provides a concentration that prevents gelation.

In another embodiment, the cationic polyacrylamide composition comprises a polyacrylamide having a molecular weight (MW) between about 1,000 to about 100,000. In still another embodiment, the cationic polyacrylamide composition comprises a polyacrylamide having a molecular weight (MW) between about 5,000 to about 25,000.

Suitable crosslinking compositions suitable for use in the paper making methods of the present invention include one or more of the following compositions, each of which comprises one or more compounds according to Formula I, II-a, II, III, IV, V, or VI and may optionally further comprise one or more aldehyde blocking agents.

In certain embodiments, the invention provides a method for making paper or paperboard, wherein the crosslinker composition comprises between about 20% to about 50% aldehyde generating compound by weight in an aqueous media. In a further embodiment, the crosslinker composition comprises between about 30% to about 40% aldehyde generating compound by weight in an aqueous media.

In other embodiments, the crosslinker composition comprises at least one equivalent of a compound having at least two aldehyde residues and between about 0.05 and about 5 equivalents of one or more stabilizing compounds. In a further embodiment, the compound having at least two aldehyde residues is a glyoxal releasing compound. In another embodiment, the compound having at least two aldehyde residues is glyoxal.

In a further embodiment, one or more stabilizing compound is a linear, branched or cyclic organic molecule having at least two functional groups capable of blocking an aldehyde residue.

In other embodiment, the invention provides a method as described above, wherein the crosslinker composition further comprises at least one aldehyde blocking agent. In certain embodiments, the crosslinker composition comprises at least 0.1 molar equivalent of aldehyde blocking agent relative to the aldehyde generating compound. In other embodiments, the crosslinker composition comprises at least one aldehyde blocking agent selected from urea, thiourea, amines, alkanols, alkane diols, and alkylene glycols.

Preferred crosslinker compositions for use in the methods of strengthening paper or paperboard provided by the present invention include those crosslinker compositions comprising:

an aqueous media; and a monomeric or oligomeric aldehyde generating compound comprising at least one equivalent of a dialdehyde or polyaldehyde compound; and between 0.05 and about 5 equivalents of a stabilizing agent which is capable of reacting with two or more aldehyde residues.

In other preferred embodiments, the invention provides crosslinker composition which comprise an aldehyde generating compound which releases glyoxal.

In certain preferred embodiments, the crosslinker composition comprises an aldehyde generating compound having at least one stabilizing agent which is selected from linear, branched or cyclic organic molecules having at least two functional groups capable of blocking an aldehyde residue. Typically preferred stabilizing agents include, but are not limited to optionally substituted urea, optionally substituted thiourea, optionally substituted amines, optionally substituted alkanols, optionally substituted alkane diols, optionally substituted guanidine, optionally substituted alkylene glycol, optionally substituted α,ω-akanediol, optionally substituted poly(ethylene glycol), optionally substituted imidazolidin-2-one, optionally substituted tetrahydro-pyrimidin-2-one, and combinations thereof.

In certain particularly preferred embodiments, the stabilizing agent has a molecular weight of less than 1000 g/mol. More preferably, the stabilizing agent having a molecular weight of 1000 g/mol or less is selected from optionally substituted urea, optionally substituted thiourea, optionally substituted guanidine, optionally substituted alkylene glycol, optionally substituted α,ω-akanediol, optionally substituted poly(ethylene glycol), optionally substituted imidazolidin-2-one, optionally substituted tetrahydro-pyrimidin-2-one, and combinations thereof.

In yet other embodiments, the present invention provides crosslinking compositions which further comprise one or more aldehyde blocking compounds which are present in the crosslinking composition at between about 0 and about 20 molar % of the aldehyde generating compound. Certain preferred aldehyde blocking compounds are selected from the group consisting of $C_{1-20}$alcohols, $C_{2-20}$alkylene glycols, and $C_{1-20}$alkylamines, and the like. Particularly preferred aldehyde blocking compound include methanol, ethanol, propanol, ethylene glycol, and propylene glycol, and the like.

Certain preferred crosslinker compositions, which are suitable for use in the paper manufacturing methods of the invention, comprise an aldehyde generating compound or a glyoxal generating compound which is a compound according to Formula I:

I

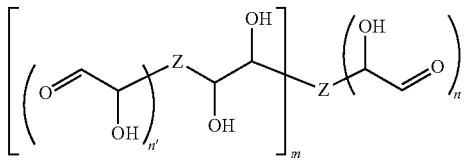

wherein

Z is monovalent or divalent urea, monovalent or divalent α,ω-$C_{2-8}$alkanediol, $C_{2-8}$alkylene glycol, poly(ethylene glycol) having a molecular weight of less than about 20,000, ω-amino-α-$C_{2-8}$alkanol or Z is a 5 to 7 member optionally substituted heterocyclic group having one ring nitrogen atom, at least one additional ring heteroatom selected from N, O, or S, and zero or one oxo substitutents;

n is 0, 1, or 2;

m is 0 or 1;

n'=n if m=1 or n'=0 if m=0, wherein at least one of m and n is not zero.

Other preferred crosslinker compositions, which are suitable for use in the paper manufacturing methods of the invention, comprise an aldehyde generating compound or a glyoxal releasing compound which is a compound according to Formula II:

II

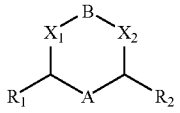

wherein

A is an optionally substituted methylene group, an optionally substituted $C_{2-4}$alkylene group, or a single bond;

B is carbonyl, thiocarbonyl, or an optionally substituted 1,2-ethylene residue;

$X_1$ and $X_2$ are independently selected from the group consisting of oxygen and $NR_3$;

$R_1$ and $R_2$ are independently selected from the group consisting of hydrogen, hydroxy, optionally substituted $C_{1-20}$alkyl, optionally substituted $C_{1-20}$alkoxy, optionally substituted urea, optionally substituted thiourea, or $R_1$ and $R_2$, taken in combination, form a N,N'-divalent urea;

$R_3$ is independently selected at each occurrence of $R_3$ from the group consisting of hydrogen, 1-hydroxy-ethan-2-al-1-yl group, or a blocked glyoxal residue.

Certain preferred crosslinker compositions of the present invention comprise an aldehyde generating compound or a glyoxal releasing compound which is a compound according to Formula II-a:

II-a

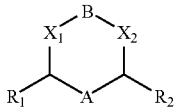

wherein

A is an optionally substituted methylene group, an optionally substituted $C_{2-4}$alkylene group, or a single bond;

B is carbonyl, thiocarbonyl, or an optionally substituted 1,2-ethylene residue;

$X_1$ and $X_2$ are independently selected from the group consisting of oxygen and $NR_3$;

$R_1$ and $R_2$ are independently selected from the group consisting of hydrogen, hydroxy, optionally substituted $C_{1-20}$alkyl, optionally substituted $C_{1-20}$alkoxy, optionally substituted urea, optionally substituted thiourea, or $R_1$ and $R_2$, taken in combination, form a N,N'-divalent urea;

$R_3$ is independently selected at each occurrence of $R_3$ from the group consisting of hydrogen, optionally substituted $C_{1-20}$alkyl, and unblocked and blocked glyoxal residues, where unblocked glyoxal residue is a 1-hydroxy-2-ethanal-1-yl group and the blocked glyoxal residue is a 1-hydroxy-2-(protected aldehyde residue)-ethan-1-yl group; or $R_3$ is a 1,2-dihydroxyethylene residue coupled to two rings according to Formula I; and wherein the aldehyde generating compound according to Formula I degrades to generate at least one equivalent of glyoxal when the crosslinking composition is contacted with cationic polyacrylamide or pulp fiber.

Preferred compounds of Formula II or II-a, which are suitable for use in the crosslinking compositions of the invention include those compounds in which:

$R_1$ and $R_2$ are independently selected from the group consisting of hydrogen, hydroxy, methanol, ethanol, urea, or $R_1$ and $R_2$, taken in combination, form a N,N'-divalent urea;

$R_3$ is independently selected at each occurrence of $R_3$ from the group consisting of hydrogen, methyl, and ethyl, or $R_3$ is an unblocked glyoxal residue or a blocked glyoxal residue selected from the group consisting of 1,2-dihydroxy-2-($C_{1-4}$-alkoxy)-ethan-1-yl, 1,2-dihydroxy-2-(3-hydroxypropoxy)-ethan-1-yl, and 1,2-dihydroxy-2-(2-hydroxypropoxy)-ethan-1-yl.

Other preferred compounds of Formula II or II-a, which are suitable for use in the crosslinking compositions of the invention include those compounds in which:

$X_1$ and $X_2$ are $NR_3$;

A is a single bond;

B is a carbonyl or thiocarbonyl group; and $R_1$ and $R_2$ are independently selected from hydroxy, $C_{1-6}$alkoxy, or blocked glyoxal residues.

Still other preferred compounds of Formula II or II-a, which are suitable for use in the crosslinking compositions of the invention include those compounds in which:

$X_1$ and $X_2$ are $NR_3$;

A is a 1,1-$C_{1-6}$alkylene group;

B is a carbonyl or thiocarbonyl group;

$R_1$ and $R_2$ are independently selected from hydrogen, hydroxy, or $C_{1-6}$alkoxy, and $R_3$ is an unblocked glyoxal residue or a blocked glyoxal residue selected from the group consisting of 1,2-dihydroxy-2-($C_{1-4}$-alkoxy)-ethan-1-yl, 1,2-dihydroxy-2-(3-hydroxypropoxy)-ethan-1-yl, and 1,2-dihydroxy-2-(2-hydroxypropoxy)-ethan-1-yl.

Other preferred aldehyde generating compounds provided by the invention which are suitable for use in the methods of the invention comprise substituted triaminoheteroaromatic and substituted triaminobenzene compounds according to Formula III:

III

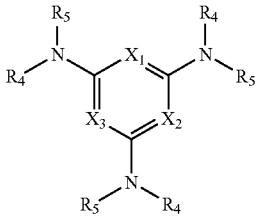

wherein each of $X_1$, $X_2$, and $X_3$ are independently selected from the group consisting of CH or N; and $R_4$ and $R_5$ are independently selected at each occurrence of $R_4$ and $R_5$ in Formula III from the group selected from hydrogen, a 1-hydroxy-ethan-2-al-1-yl group, or a blocked glyoxal residue; or one or more occurrences of $NR_4R_5$ in Formula III, taken in combination form an optionally substituted N-piperazinyl residue.

Particularly preferred compounds of Formula III include 1,3,5-triazine compounds, e.g., compounds of Formula III in which each of $X_1$, $X_2$, and $X_3$ is nitrogen.

Other preferred compounds of Formula III include those compounds in which one or more, or preferably each occurrence of $NR_4R_5$, taken in combination, forms an optionally substituted N-2,3,5,6-tetrahydroxypiperazinyl residue. Particularly preferred compounds of Formula III, in which $NR_4R_5$, taken in combination, forms a N-2,3,5,6-tetrahydroxypiperazinyl residue include compounds of Formula IV:

IV

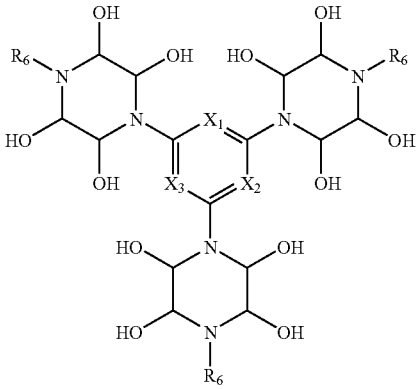

wherein each of $X_1$, $X_2$, and $X_3$ are independently selected from the group consisting of CH or N; and $R_6$ is independently selected at each occurrence from the group selected from optionally substituted alkyl, optionally substituted carboxamide.

Preferred aldehyde generating compounds of formula IV include those compounds in which $R_6$ is independently selected at each occurrence from —C(O)$NH_2$ or —C(O)NHCH(OH)CHO.

Yet other preferred aldehyde generating compounds which are suitable for use in the methods of manufacturing paper provided by the invention include those compounds according to V:

V

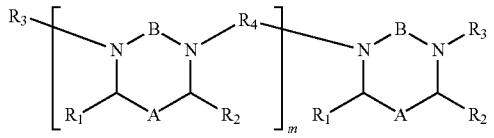

wherein m is an integer from 0 to about 1000;

A is an optionally substituted methylene group, an optionally substituted $C_{2-4}$alkylene group, or a single bond;

B is carbonyl, thiocarbonyl, or an optionally substituted 1,2-ethylene residue;

$R_1$ and $R_2$ are independently selected from the group consisting of hydrogen, hydroxy, optionally substituted $C_{1-20}$alkyl, optionally substituted $C_{1-20}$alkoxy, optionally substituted urea, optionally substituted thiourea, or $R_1$ and $R_2$, taken in combination, form a N,N'-divalent urea;

$R_3$ is independently selected at each occurrence of $R_3$ from the group consisting of hydrogen, optionally substituted $C_{1-20}$alkyl, and unblocked and blocked glyoxal residues, where unblocked glyoxal residue is a 1-hydroxy-2-ethanal-1-yl group and the blocked glyoxal residue is a 1-hydroxy-2-(protected aldehyde residue)-ethan-1-yl group; or $R_4$ is a 1,2-dihydroxyethylene residue; or $R_4$ is a telechelic oligiomer comprising 2n+1 glyoxal residues alternating with n groups selected from the group consisting of α,ω-alkane diols, alkylene glycols, and poly(ethylene glycol); and n is an integer of from 0 to about 100;

wherein the aldehyde generating compound according to Formula II degrades to generate at least one equivalent of glyoxal when the crosslinking composition is contacted with cationic polyacrylamides or pulp fiber.

Other preferred compounds of Formula I, which are suitable for use in the crosslinking compositions of the invention include those compounds according to Formula VI:

VI

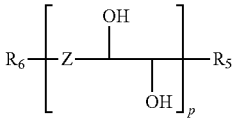

wherein p is an integer from 1 to about 1000;

Z is independently selected at each occurrence from the group consisting of optionally substituted urea, optionally substituted thiourea, optionally substituted guanidine, optionally substituted alkylene glycol, optionally substituted α,ω-akanediol, optionally substituted poly(ethylene glycol), optionally substituted imidazolidin-2-one, and optionally substituted tetrahydro-pyrimidin-2-one;

wherein the aldehyde generating compound according to Formula VI degrades to generate at least one equivalent of glyoxal when the crosslinking composition is contacted with cationic polyacrylamides or pulp fiber.

$R_5$ is hydrogen, alkoxy, hydroxyalkoxy, amino, hydroxy, mono and dialkyl amino, optionally substituted alkane diol, optionally substituted urea, or optionally substituted alkylene glycol; and $R_6$ is hydrogen, optionally substituted alkyl, optionally substituted alkanoyl, optionally substituted unblocked glyoxal residue, or blocked glyoxal residues.

Certain preferred aldehyde generating compounds or glyoxal generating compounds according to Formula VI, include those compounds wherein Z is urea, thiourea, $C_{2-10}$α,ω-alkanediol, $C_{2-10}$alkylene glycol, poly(ethyleneglycol) having between 2 and about 100 glycol repeat units.

Certain particularly preferred aldehyde generating compounds and glyoxal generating compound, which are suitable for use in the crosslinking compositions of the present invention, include compounds of the formulae:

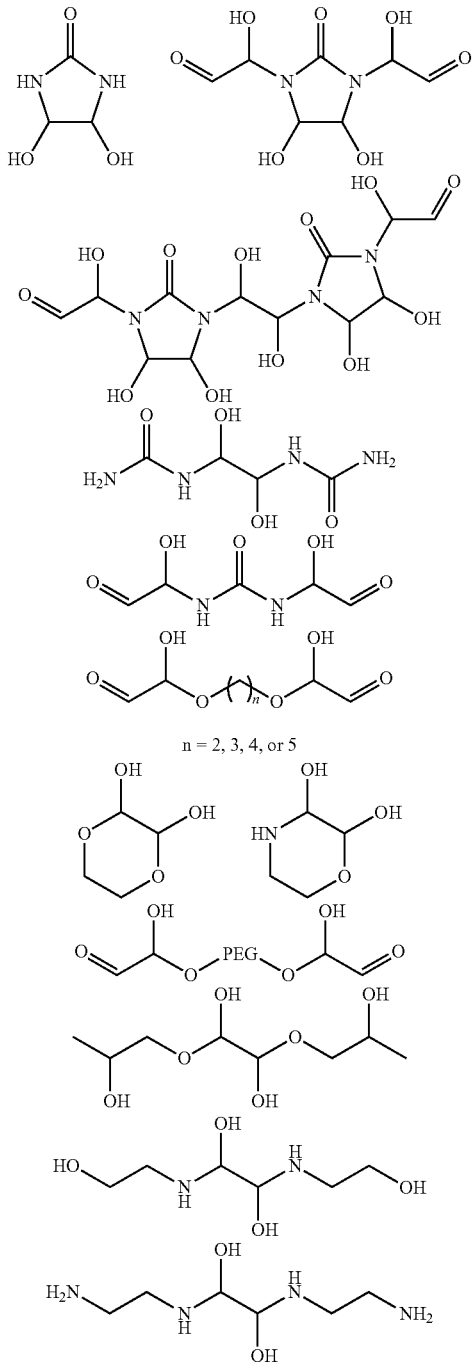

-continued

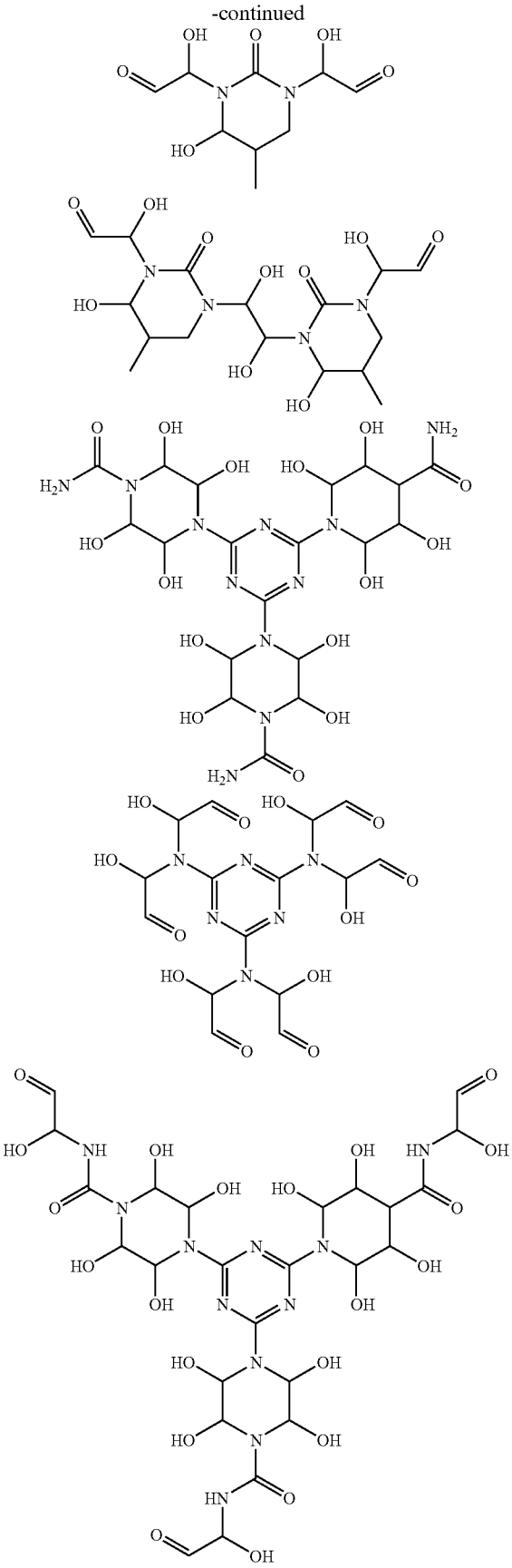

The term "optionally substituted" refers to a hydrogen radical on a compound or group (such as, for example, alkyl, alkenyl, alkynyl, alkylene, aryl, aralkyl, heteroaryl, heteroaralkyl, cycloalkyl, cyclyl, heterocycloalkyl, or heterocyclyl group) that is replaced with any desired group. Examples of substituents include, but are not limited to, halogen (F, Cl, Br, or I), hydroxyl, amino, alkylamino, arylamino, dialkylamino, diarylamino, cyano, nitro, mercapto, oxo (i.e., carbonyl), thio, imino, formyl, carbamido, carbamyl, carboxyl, thioureido, thiocyanato, sulfoamido, sulfonylalkyl, sulfonylaryl, alkyl, alkenyl, alkoxy, mercaptoalkoxy, aryl, heteroaryl, cyclyl, heterocyclyl, wherein alkyl, alkenyl, alkyloxy, aryl, heteroaryl, cyclyl, and heterocyclyl are optionally substituted with alkyl, aryl, heteroaryl, halogen, hydroxyl, amino, mercapto, cyano, nitro, oxo (=O), thioxo (=S), or imino (=NR).

In other embodiments, substituents on any group can be at any atom of that group, wherein any group that can be substituted (such as, for example, alkyl, alkenyl, alkynyl, aryl, aralkyl, heteroaryl, heteroaralkyl, cycloalkyl, heterocycloalkyl, and heterocycloalkyl) can be optionally substituted with one or more substituents (which may be the same or different), each replacing a hydrogen atom. Examples of suitable substituents include, but not limited to alkyl, alkenyl, alkynyl, cycloalkyl, heterocycloalkyl, aralkyl, heteroaralkyl, aryl, heteroaryl, halogen, haloalkyl, cyano, nitro, alkoxy, aryloxy, hydroxyl, hydroxylalkyl, oxo (i.e., carbonyl), carboxyl, formyl, alkylcarbonyl, alkylcarbonylalkyl, alkoxycarbonyl, alkylcarbonyloxy, aryloxycarbonyl, heteroaryloxy, heteroaryloxycarbonyl, thio, mercapto, mercaptoalkyl, arylsulfonyl, amino, aminoalkyl, dialkylamino, alkylcarbonylamino, alkylaminocarbonyl, or alkoxycarbonylamino; alkylamino, arylamino, diarylamino, alkylcarbonyl, or arylamino-substituted aryl; arylalkylamino, aralkylaminocarbonyl, amido, alkylaminosulfonyl, arylaminosulfonyl, dialkylaminosulfonyl, alkylsulfonylamino, arylsulfonylamino, imino, carbamido, carbamyl, thioureido, thiocyanato, sulfoamido, sulfonylalkyl, sulfonylaryl, or mercaptoalkoxy.

Additional suitable substituents include, without limitation halogen, CN, $NO_2$, $OR^{15}$, $SR^{15}$, $S(O)_2OR^{15}$, $NR^{15}R^{16}$, $C_1$-$C_2$ perfluoroalkyl, $C_1$-$C_2$ perfluoroalkoxy, 1,2-methylenedioxy, (=O), (=S), (=$NR^{15}$), $C(O)OR^{15}$, $C(O)NR^{15}R^{16}$, $OC(O)NR^{15}R^{16}$, $NR^{15}C(O)NR^{15}$, $R^{16}$, $C(NR^{16})NR^{15}R^{16}$, $NR^{15}C(NR^{16})NR^{15}R^{16}$, $S(O)_2NR^{15}R^{16}$, $R^{17}$, C(O)H, $C(O)R^{17}$, $NR^{15}C(O)R^{17}$, $Si(R^{15})_3$, $OSi(R^{15})_3$, $Si(OH)_2R^{15}$, $B(OH)_2$, $P(O)(OR^{15})_2$, $S(O)R^{17}$, or $S(O)_2R^{17}$. Each $R^{15}$ is independently hydrogen, $C_1$-$C_6$ alkyl optionally substituted with cycloalkyl, aryl, heterocyclyl, or heteroaryl. Each $R^{16}$ is independently hydrogen, $C_3$-$C_6$ cycloalkyl, aryl, heterocyclyl, heteroaryl, $C_1$-$C_4$ alkyl or $C_1$-$C_4$ alkyl substituted with $C_3$-$C_6$ cycloalkyl, aryl, heterocyclyl or heteroaryl. Each $R^{17}$ is independently $C_3$-$C_6$ cycloalkyl, aryl, heterocyclyl, heteroaryl, $C_1$-$C_4$ alkyl or $C_1$-$C_4$ alkyl substituted with $C_3$-$C_6$ cycloalkyl, aryl, heterocyclyl or heteroaryl. Each $C_3$-$C_6$ cycloalkyl, aryl, heterocyclyl, heteroaryl and $C_1$-$C_4$ alkyl in each $R^{15}$, $R^{16}$ and $R^{17}$ can optionally be substituted with halogen, CN, $C_1$-$C_4$ alkyl, OH, $C_1$-$C_4$ alkoxy, COOH, $C(O)OC_1$-$C_4$ alkyl, $NH_2$, $C_1$-$C_4$ alkylamino, or $C_1$-$C_4$ dialkylamino.

As used herein, "alkyl" is intended to include both branched and straight-chain saturated aliphatic hydrocarbon groups, having 1 to 30 carbon atoms. Examples of alkyl include, but are not limited to, methyl, ethyl, n-propyl, i-propyl, n-butyl, s-butyl, t-butyl, n-pentyl, and s-pentyl. Preferred alkyl groups are $C_{1-6}$ alkyl groups. Especially preferred alkyl groups are methyl, ethyl, propyl, butyl, and 3-pentyl.

"Cycloalkyl" refers to a hydrocarbon 3-8 membered monocyclic or 7-14 membered bicyclic ring system having at least one saturated ring. Cycloalkyl groups may be optionally substituted with one or more substituents. In one embodiment, 0, 1, 2, 3, or 4 atoms of each ring of a cycloalkyl group may be substituted by a substituent. Representative examples of cycloalkyl group include cyclopropyl, cyclopentyl, cyclohexyl, cyclobutyl, cycloheptyl, cyclooctyl, cyclononyl, and cyclodecyl. "Cycloalkyl" also refers to a hydrocarbon 3-8 membered monocyclic or 7-14 membered bicyclic ring system having at least one non-aromatic ring, wherein the non-aromatic ring has some degree of unsaturation. Cycloalkyl groups may be optionally substituted with one or more substituents. In one embodiment, 0, 1, 2, 3, or 4 atoms of each ring of a cyclyl group may be substituted by a substituent. Examples of cycloalkyl groups include cyclohexenyl, bicyclo[2.2.1]hept-2-enyl, dihydronaphthalenyl, benzocyclopentyl, cyclopentenyl, cyclopentadienyl, cyclohexenyl, cyclohexadienyl, cycloheptenyl, cycloheptadienyl, cycloheptatrienyl, cyclooctenyl, cyclooctadienyl, cyclooctatrienyl, cyclooctatetraenyl, cyclononenyl, cyclononadienyl, cyclodecenyl, cyclodecadienyl and the like.

"Alkenyl" is intended to include hydrocarbon chains of either a straight or branched configuration comprising one or more unsaturated carbon-carbon bonds, which may occur in any stable point along the chain, such as ethenyl and propenyl. Alkenyl groups typically will have 2 to about 8 carbon atoms, more typically 2 to about 6 carbon atoms.

"Alkynyl" is intended to include hydrocarbon chains of either a straight or branched configuration comprising one or more carbon-carbon triple bonds, which may occur in any stable point along the chain, such as ethynyl and propynyl. Alkynyl groups typically will have 2 to about 8 carbon atoms, more typically 2 to about 6 carbon atoms.

"Alkoxy" represents an alkyl group as defined above with the indicated number of carbon atoms attached through an oxygen bridge. Examples of alkoxy include, but are not limited to, methoxy, ethoxy, n-propoxy, i-propoxy, n-butoxy, 2-butoxy, t-butoxy, n-pentoxy, 2-pentoxy, 3-pentoxy, isopentoxy, neopentoxy, n-hexoxy, 2-hexoxy, 3-hexoxy, and 3-methylpentoxy. Alkoxy groups typically have 1 to about 8 carbon atoms, more typically 1 to about 6 carbon atoms.

The term "mercapto" refers to a —SH group.

As used herein, the term "halogen" or "halo" means —F, —Cl, —Br or —I.

As used herein, the term "haloalkyl" means an alkyl group in which one or more (including all) of the hydrogen radicals are replaced by a halo group, wherein each halo group is independently selected from —F, —Cl, —Br, and —I. The term "halomethyl" means a methyl in which one to three hydrogen radical(s) have been replaced by a halo group. Representative haloalkyl groups include trifluoromethyl, bromomethyl, 1,2-dichloroethyl, 4-iodobutyl, 2-fluoropentyl, and the like.

The term "aryl" refers to a hydrocarbon monocyclic, bicyclic or tricyclic aromatic ring system. Aryl groups may be optionally substituted with one or more substituents. In one embodiment, 0, 1, 2, 3, 4, 5 or 6 atoms of each ring of an aryl group may be substituted by a substituent. Examples of aryl groups include phenyl, naphthyl, anthracenyl, fluorenyl, indenyl, azulenyl, and the like.

As used herein, the term "aralkyl" means an aryl group that is attached to another group by a $(C_1-C_6)$alkylene group. Aralkyl groups may be optionally substituted, either on the aryl portion of the aralkyl group or on the alkylene portion of the aralkyl group, with one or more substituents. Representative aralkyl groups include benzyl, 2-phenyl-ethyl, naphth-3-yl-methyl and the like.

The term "arylalkoxy" refers to an alkoxy substituted with aryl.

The term "heteroaryl" refers to an aromatic 5-8 membered monocyclic, 8-12 membered bicyclic, or 11-14 membered tricyclic ring system having 1-4 ring heteroatoms if monocyclic, 1-6 heteroatoms if bicyclic, or 1-9 heteroatoms if tricyclic, said heteroatoms selected from O, N, or S, and the remainder ring atoms being carbon (with appropriate hydrogen atoms unless otherwise indicated). Heteroaryl groups may be optionally substituted with one or more substituents. In one embodiment, 0, 1, 2, 3, or 4 atoms of each ring of a heteroaryl group may be substituted by a substituent. Examples of heteroaryl groups include pyridyl, 1-oxo-pyridyl, furanyl, benzo[1,3]dioxolyl, benzo[1,4]dioxinyl, thienyl, pyrrolyl, oxazolyl, oxadiazolyl, imidazolyl thiazolyl, isoxazolyl, quinolinyl, pyrazolyl, isothiazolyl, pyridazinyl, pyrimidinyl, pyrazinyl, triazinyl, triazolyl, thiadiazolyl, isoquinolinyl, indazolyl, benzoxazolyl, benzofuryl, indolizinyl, imidazopyridyl, tetrazolyl, benzimidazolyl, benzothiazolyl, benzothiadiazolyl, benzoxadiazolyl, indolyl, tetrahydroindolyl, azaindolyl, imidazopyridyl, quinazolinyl, purinyl, pyrrolo[2,3]pyrimidinyl, pyrazolo[3,4]pyrimidinyl, and benzo(b)thienyl, 3H-thiazolo[2,3-c][1,2,4]thiadiazolyl, imidazo[1,2-d]-1,2,4-thiadiazolyl, imidazo[2,1-b]-1,3,4-thiadiazolyl, 1H,2H-furo[3,4-d]-1,2,3-thiadiazolyl, 1H-pyrazolo[5,1-c]-1,2,4-triazolyl, pyrrolo[3,4-d]-1,2,3-triazolyl, cyclopentatriazolyl, 3H-pyrrolo[3,4-c]isoxazolyl, 1H,3H-pyrrolo[1,2-c]oxazolyl, pyrrolo[2,1b]oxazolyl, and the like.

As used herein, the term "heteroaralkyl" or "heteroarylalkyl" means a heteroaryl group that is attached to another group by a $(C_1-C_6)$alkylene. Heteroaralkyl groups may be optionally substituted, either on the heteroaryl portion of the heteroaralkyl group or on the alkylene portion of the heteroaralkyl group, with one or more substituent. Representative heteroaralkyl groups include 2-(pyridin-4-yl)-propyl, 2-(thien-3-yl)-ethyl, imidazol-4-yl-methyl and the like.

The term "heterocycloalkyl" refers to a nonaromatic 3-8 membered monocyclic, 7-12 membered bicyclic, or 10-14 membered tricyclic ring system comprising 1-3 heteroatoms if monocyclic, 1-6 heteroatoms if bicyclic, or 1-9 heteroatoms if tricyclic, said heteroatoms selected from O, N, S, B, P or Si, wherein the nonaromatic ring system is completely saturated. Heterocycloalkyl groups may be optionally substituted with one or more substituents. In one embodiment, 0, 1, 2, 3, or 4 atoms of each ring of a heterocycloalkyl group may be substituted by a substituent. Representative heterocycloalkyl groups include piperidinyl, piperazinyl, 2-oxopiperazinyl, 2-oxopiperidinyl, 2-oxopyrrolidinyl, 4-piperidonyl, tetrahydropyranyl, tetrahydrothiopyranyl, tetrahydrothiopyranyl sulfone, morpholinyl, thiomorpholinyl, thiomorpholinyl sulfoxide, thiomorpholinyl sulfone, 1,3-dioxolane, tetrahydrofuranyl, tetrahydrothienyl, thiirene. The term "heterocycloalkyl" also refers to a nonaromatic 5-8 membered monocyclic, 7-12 membered bicyclic, or 10-14 membered tricyclic ring system comprising 1-3 heteroatoms if monocyclic, 1-6 heteroatoms if bicyclic, or 1-9 heteroatoms if tricyclic, said heteroatoms selected from O, N, S, B, P or Si, wherein the nonaromatic ring system has some degree of unsaturation. Heterocycloalkyl groups may be optionally substituted with one or more substituents. In one embodiment, 0, 1, 2, 3, or 4 atoms of each ring of a heterocycloalkyl group may be substituted by a substituent. Examples of these groups include thiirenyl, thiadiazirinyl, dioxazolyl, 1,3-oxathiolyl, 1,3-dioxolyl, 1,3-dithiolyl, oxathiazinyl, dioxazinyl, dithiazinyl, oxadiazinyl, thiadiazinyl, oxazinyl, thiazinyl, 1,4-oxathiin,1,4-dioxin, 1,4-dithiin, 1H-pyranyl, oxathiepinyl, 5H-1,4-dioxepinyl, 5H-1,4-dithiepinyl, 6H-isoxazolo[2,3-d]1,2,4-oxadiazolyl, 7aH-oxazolo[3,2-d]1,2,4-oxadiazolyl, and the like.

The term "alkylamino" refers to an amino substituent which is further substituted with one or two alkyl groups. The term "aminoalkyl" refers to an alkyl substituent which is further substituted with one or more amino groups. The term "mercaptoalkyl" refers to an alkyl substituent which is further substituted with one or more mercapto groups. The term "hydroxyalkyl" or "hydroxylalkyl" refers to an alkyl substituent which is further substituted with one or more hydroxyl groups. The term "sulfonylalkyl" refers to an alkyl substituent which is further substituted with one or more sulfonyl groups. The term "sulfonylaryl" refers to an aryl substituent which is further substituted with one or more sulfonyl groups. The term "alkylcarbonyl" refers to an —C(O)-alkyl. The term "mercaptoalkoxy" refers to an alkoxy substituent which is further substituted with one or more mercapto groups. The term "alkylcarbonylalkyl" refers to an alkyl substituent which is further substituted with —C(O)-alkyl. The alkyl or aryl portion of alkylamino, aminoalkyl, mercaptoalkyl, hydroxyalkyl, mercaptoalkoxy, sulfonylalkyl, sulfonylaryl, alkylcarbonyl, and alkylcarbonylalkyl may be optionally substituted with one or more substituents.

The recitation of a listing of chemical groups in any definition of a variable herein includes definitions of that variable as any single group or combination of listed groups. The recitation of an embodiment for a variable herein includes that embodiment as any single embodiment or in combination with any other embodiments or portions thereof.

Since these type of crosslinking reactions depend to a high degree on a good number of parameters such as time, temperature, pH, reactant concentrations and ratios; satisfactory control of the desired degree of crosslinking is a very complex task. To carry out this on-site reaction in a practical way, under precisely controlled conditions, a suitable reactor technology can be selected that is capable of accomplishing very rapid mixing and instant heating without the use of conventional heat transfer methods.

One currently known such technology is inline mixing combined with microwave heating. Another, more preferred technology applies cavitation energy for extremely rapid simultaneous mixing and heating in one step. An eminently suitable device/reactor to accomplish this task is described by J. L. Griggs in U.S. Pat. No. 5,188,090, the contents of which are incorporated herein by reference.

EXAMPLES

The present invention is further illustrated by the following examples, which should not be construed as limiting in any way. The practice of the present invention will employ, unless otherwise indicated, conventional techniques, which are within the skill of the art. Such techniques are explained fully in the literature.

Handsheet Preparation Procedure

Laboratory handsheets were prepared using the MK sheet forming device in semi-automatic mode. Pulp was beaten to 300 CSF (Canadian Standard Freeness) using a laboratory beater. Additions were made to a 1% slurry of the pulp prior to addition to the headbox. Sheets (12×12") were formed using conventional practice, pressed, and dryed at 120° C. using 2 passes through a felted rotating cylinder dryer. A pass is one rotation around the heated drum. The speed of this rotation is adjustable. For this study the rotation took 1 minute. The pulp slurries were prepared in ordinary tap water without pH adjustment. Old Corrugated Containers (OCC) was obtained from commercial box clippings.

Example 1

Preparation of a Mixture of 3,4-Dihydroxy-Imidazolidin-2-One and at Least One Aldehyde Blocking Compound A 1000 ml flask was charged with glyoxal (40% in water, 145 grams, 1 mole) and the contents of the flask were stirred and warmed to 55° C. Urea (50% in water, 120 grams, 1 mole) was added to the stirred glyoxal solution over four hours at 55° C. To this mixture propylene glycol (38 grams, 0.5 moles) and a catalytic amount of sulfuric acid (98%, typically about 1 gram) was added. The reaction mixture was then heated to 70° C. for two hours to generate the product, of which the predominant reaction produce had the structure, as follows:

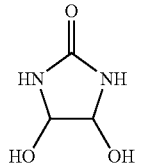

Example 2

Preparation of a Cyclic Glyoxal with Pendant Blocked Glyoxal Residues

A 1000 ml flask was charged with glyoxal (40% in water, 435 grams, 3 moles) and the contents of the flask were stirred and warmed to 55° C. Urea (50% in water, 120 grams, 1 mole) was added to the stirred glyoxal solution over two hours at 55° C. A catalytic amount of sulfuric acid (98%, typically about 1 gram) was added to the reaction mixture to accelerate the cyclization reaction. The reaction mixture was allowed to stir for four hours and then propylene glycol (152 grams, 2 moles) was added. The reaction mixture was then heated to 70° C. for two hours to generate the product, of which the predominant reaction produce had the structure, as follows:

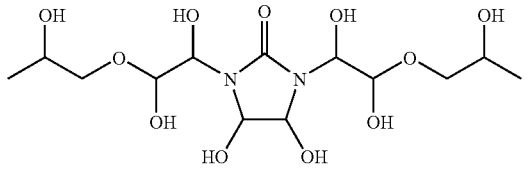

Example 3

Preparation of Cyclic Amide with Pendent Blocked Glyoxal Units

Sodium bicarbonate (7.5 grams) was introduced into a sealed nitrogen filled round bottom flask fixed with heating, cooling, reflux, distillation, pH probe, temperature probe and constant pressure addition apparatus. Formaldehyde (37% in water, 172 grams, 2 moles) was then added to the flask. Propionaldehyde (116 grams, 2 moles) was then slowly added to the reaction mixture over 2 hours at 30° C. Upon complete addition of the propionaldehyde, the reaction solution was heated to 45° C. for 4 hours. Urea (120 grs (2 moles)) was then added and the temperature of the reaction mixture increased to 60° C. for 2 hours. Residual raw materials and a small amounts of reaction by-products were then removed from the reaction flask by vacuum distillation. Sulfuric acid (98%, 6.25 grams) was added to the material remaining in the flask after distillation and the reaction mixture was held at 60° C. for 4 hours.

Glyoxal (40% by weight in water; 290 grams, 2 moles) and propylene glycol (152 grams, 2 moles) were added sequentially at 55° C. to the reaction mixture. The reaction mixture was allowed to stir for an hour after complete addition of each reagent, e.g., glyoxal and propylene glycol.

The reaction mixture was returned to room temperature and the pH was adjusted to about 6.5 by addition of sodium bicarbonate. The predominate glyoxal generating compound formed by the reaction is represented by the structure, as follows:

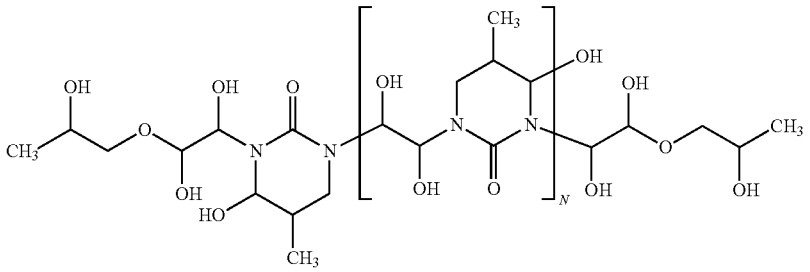

Example 4

Preparation of a Cyclic Glyoxal Compound with Pendant Glyoxal Residues and No Aldehyde Blocking A 1000 ml flask was charged with glyoxal (40% in water, 435 grams, 3 moles) and sulfuric acid (98%, 2 grs) and was stirred and warmed to 65° C. Urea (50% in water, 120 grams, 1 mole) was added to the stirred glyoxal solution over four hours at 65° C. The reaction mixture was held for two hours at 70° C. to generate the product, of which the predominant reaction product had the structure, as follows:

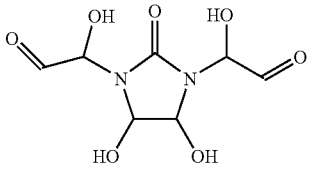

Example 5

Base Polymer Definition

For the rapid crosslinking experiment a low molecular weight linear cationic polyacrylamide was obtained from a commercial source. The product had a cationic charge of 0.21 meq/gram, pH=3.5, solids concentration of 41.2%, viscosity of 950 cPs at 25 degree C.

Example 6

Strength Additive Preparation in a Continuous Reactor

The pilot plant set up was as follows:- 1,000 ml free volume reactor metering pumps for the addition of the cationic polyacrylamide and the crosslinker Component addition rates:- 1,048 mL/min base polymer 22 ml/min blocked glyoxal crosslinker Reaction temperature: 70.0° C.

Reactor pH 8.05

As the reaction product was exiting the reactor it was promply diluted with room temperature water to about 8% solids in a small stainless steel tank equipped with a mixer. In order to arrest the crosslinking reaction and preserve its representative strengthening properties for the handsheet evaluation, the pH was adjusted to 3.5 with dilute HCl and 250 ml size samples were taken and refrigerated at 4.0° C.

Example 7

Comparison of an 8% Solids Commercial Strength Agent (Baystrength 3000 with the Preserved Sample of Example 6

Several sets of handsheets were prepared by the previously described "Handsheet preparation procedure".

The pulp stock OCC furnish obtained from a linerboard mill:

| | |
|---|---|
| Freeness: | 350-360 CSF |
| pH: | 7.3 |
| ASA size | 10.0 lbs/ton |
| Wet end starch | 10.0 lbs/ton |
| Strength additives | 10.0 lbs/ton |

1.0 inch wide strips from the handsheets were cut for tensile strength testing according to TAPPI Method T494 om-88.

Tensile strength improvement over untreated handsheets:

| | |
|---|---|
| Baystrength 3000 | 14.5% |
| Example 6. | 20.1% |

The rapid crosslinked Example 6 strength additive demonstrated better than equal strength improvement against the conventional commercial product.

All references cited herein, whether in print, electronic, computer readable storage media or other form, are expressly incorporated by reference in their entirety, including but not limited to, abstracts, articles, journals, publications, texts, treatises, technical data sheets, internet web sites, databases, patents, patent applications, and patent publications.

What is claimed is:

1. A method for manufacturing paper or paperboard sheet with increased strength, the method comprising the steps of:

providing a fiber slurry and a cationic polyacrylamide composition, each of which is suitable for use in making paper or paperboard;

providing at least one crosslinker composition comprising at least one aldehyde generating compound capable of forming at least two or more covalent bonds to functional groups present in the cationic polyacrylamide composition;

mixing the cationic polyacrylamide composition and the crosslinker composition to form a mixture;

reacting the mixture in a reactor in a continuous process at a mill site having a papermaking machine to form a concentrated strength enhancer;

diluting the concentrated strength enhancer into a strength enhancer;

adding the strength enhancer to the fiber slurry at the papermaking machine; and forming the paper or paperboard sheet, wherein the increased strength is increased wet strength or increased dry strength.

2. The method of claim 1, wherein the cationic polyacrylamide composition and the crosslinker composition are mixed together and reacted in a reactor in a continuous process providing rapid mixing and heat generation prior to dilution and addition to the fiber slurry.

3. The method of claim 1, wherein the cationic polyacrylamide composition and the crosslinker composition are mixed together less than about 10 minutes prior to addition to the fiber slurry.

4. The method of claim 1, wherein the cationic polyacrylamide composition and the crosslinker composition are mixed together at a temperature range of about 25° C. to about 100° C.

5. The method of claim 1, wherein the cationic polyacrylamide composition comprises between about 10% to about 50% cationic polyacrylamide by weight in an aqueous medium.

6. The method of claim 1, wherein the cationic polyacrylamide composition comprises a cationic polyacrylamide having a molecular weight (MW) between about 1,000 to about 100,000.

7. The method of claim 1, wherein the crosslinker composition comprises between about 20% to about 50% aldehyde generating compound by weight in an aqueous medium.

8. The method of claim 7, wherein the crosslinker composition comprises a compound having at least two aldehyde residues and one or more stabilizing compounds.

9. The method of claim 8, wherein the compound having at least two aldehyde residues is a glyoxal releasing compound.

10. The method of claim 8, wherein the compound having at least two aldehyde residues is glyoxal.

11. The method of claim 8, wherein the stabilizing compound is a linear, branched or cyclic organic molecule having at least two functional groups capable of blocking an aldehyde residue.

12. The method of claim 1, wherein the crosslinker composition further comprises at least one aldehyde blocking agent.

13. The method of claim 12, wherein the at least one aldehyde blocking agent is selected from a group consisting of urea, thiourea, amines, alkanols, alkane diols, and alkylene glycols.

14. The method of claim 1, wherein the mixing step is carried out at the mill site from less than one minute to less than one hour before addition of the strength enhancer to the fiber slurry.

15. The method of claim 1, further comprising diluting at least one of the cationic polyacrylamide composition, the crosslinker composition and the reacted mixture.

16. The method of claim 15, wherein the dilution step provides the strength enhancer at a concentration that promotes even distribution of the strength enhancer onto the fibers and prevents gelation.

17. The method of claim 1, further comprising transferring the mixture from the reactor to the fiber slurry as the strength enhancer in a continuous process without storage of the strength enhancer.

18. The method of claim 1, further comprising transferring the mixture directly from the reactor through the diluting step to the fiber slurry as the strength enhancer in a continuous process.

* * * * *